US005559891A

United States Patent [19]

Kuusama et al.

[11] Patent Number: 5,559,891

[45] Date of Patent: Sep. 24, 1996

[54] DEVICE TO BE USED FOR CHANGING THE ACOUSTIC PROPERTIES OF A ROOM

[75] Inventors: Juha Kuusama; Aki Makivirta, both of Tampere, Finland

[73] Assignee: Nokia Technology GmbH, Pforzheim, Germany

[21] Appl. No.: 316,101

[22] Filed: Sep. 30, 1994

Related U.S. Application Data

[63] Continuation-in-part of Ser. No. 16,107, Feb. 10, 1993, abandoned.

[30] Foreign Application Priority Data

Feb. 13, 1992 [FI] Finland ..... 920608

[51] Int. Cl.[6] ..... G10K 11/16

[52] U.S. Cl. ..... 381/63; 381/96; 381/71

[58] Field of Search ..... 381/63, 71, 96

[56] References Cited

U.S. PATENT DOCUMENTS

| | | | |
|---|---|---|---|
| 4,712,247 | 12/1987 | Swarte | 381/96 |
| 4,899,387 | 2/1990 | Pass | 381/96 |
| 5,025,472 | 6/1991 | Shimizu et al. | 381/63 |
| 5,172,416 | 12/1992 | Allie et al. | 381/71 |
| 5,182,774 | 1/1993 | Bourk | 381/71 |
| 5,195,140 | 3/1993 | Kudo et al. | 381/63 |

FOREIGN PATENT DOCUMENTS 9009655 8/1990 WIPO .

OTHER PUBLICATIONS

"Assisted Resonance", G. Berry et al., *Journal of the Audio Engineering Society,* Apr. 1975, vol. 24, No. 3, pp. 171–176.

"Explosive Potential", *DAK Catalog,* Fall 1984, pp. 62 and 17.

*Primary Examiner*—Forester W. Isen

*Attorney, Agent, or Firm*—Ware, Fressola, van Der Sluys & Adolphson

[57] ABSTRACT

The invention relates to a device to be used for changing the acoustic properties of a room, comprising a pressure transducer (1), a loudspeaker (2) and an electronic control circuit (3) adapted to generate, in response to pressure changes in the room, an electrical signal that serves to cancel the pressure change detected by the pressure transducer (1) when it is reproduced through the loudspeaker. For improving the properties of the room also with respect to reverberation, the device of the invention further includes an ambience generator (4) adapted to receive an electrical signal proportional to the sound present in the room and to generate, in response to said signal, a signal which produces an acoustic field containing early reflections and reverberation in the room when reproduced through the loudspeaker (2).

10 Claims, 5 Drawing Sheets

DEVICE TO BE USED FOR CHANGING THE ACOUSTIC PROPERTIES OF A ROOM

This is a CIP of Ser. No. 08/016,107, filed Feb. 10, 1993, abandoned.

TECHNICAL FIELD

The present invention relates to means to be for changing the acoustic properties of a room, and more particularly, to an active device therefor.

BACKGROUND OF THE INVENTION

Such prior art active devices have included a pressure transducer, a loudspeaker and an electronic control circuit adapted to generate, in response to pressure changes in the room, an electrical signal that serves to cancel the pressure change detected by the pressure transducer when it is reproduced through the loudspeaker. In the connection of this application, a loudspeaker means an entity constituted by one or more loudspeaker elements possibly operating over different frequency ranges.

Often when good sound reproduction is the aim attention is paid solely to the properties of the sound reproduction equipment. The listening space also has a great effect on the way the music sounds. In most cases, the listening room is the greatest factor influencing sound reproduction.

The acoustics of the listening room can be improved for instance by using different acoustic panels to line the walls and ceiling. Such passive methods are difficult to realize with frequencies below 200 Hz. To solve problems presented by low frequencies, the equipment described above has been provided, with which equipment room resonances can be attenuated or eliminated. This is based on the fact that the device can cancel low-frequency acoustic waves. Placed in a corner of a room, the device is able to attenuate standing waves present in said corner. Early reflections and reverberation found at higher frequencies, however, have a substantial effect on the character of the room as a listening space. A device of the kind described above in the prior art has no effect on the properties of the space in this respect. Typically, a normal room has too little early reflection and the reverberation is too sparse and has too short duration.

DISCLOSURE OF INVENTION

An object of the present invention is to improve the acoustic properties of a listening space.

According to the present invention, an ambience generator is responsive to an electrical signal proportional to sound provided in a space for providing an ambience signal to a loudspeaker.

In further accord with the present invention, the ambience generator provides a series of ambience signals successively delayed from the timing of the electrical signal and with diminishing amplitude. These may be provided for providing indirect sound. The indirect sound may comprise early reflections and reverberations.

In accordance still further with the present invention, the ambience generator may be selectable to provide different indirect sound responses to the input electrical signal proportional to the sound provided in the space. This provides the ability to tailor the indirect sound to the particular space or room in which the loudspeaker is located.

The device of the invention influences the properties of the room also with frequencies exceeding 200 Hz. The device of the invention further includes an ambience generator adapted to receive an electrical signal proportional to the sound present in the room and to generate, in response to said signal, a signal which produces an acoustic field containing early reflections and reverberation in the room when reproduced through the loudspeaker. The ambience generator receives the electrical signal proportional to the sound present in the room either directly from the sound reproduction equipment or through a microphone included in the equipment, said microphone most preferably being the same component that serves as a pressure transducer in connection with the control circuit. Thus the pressure transducer is most preferably a pressure sensing microphone.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
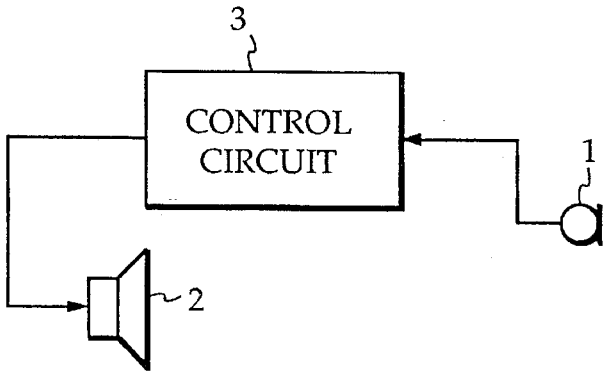
FIG. 1 PRIOR ART
FIG. 1 shows a device of the prior art for the attenuation of particularly low-frequency room resonances.

FIG. 1 shows a circuit of the prior art for the active cancellation of low-frequency room resonances. This circuit comprises a pressure-sensing microphone 1 adapted to feed a control circuit 3 the output of which has been connected to a loudspeaker 2. The pressure sensing-microphone 1 senses the pressure present in the room at the location in which the device is placed. The control circuit 3 strives to maintain the pressure sensed by the pressure sensing microphone 1 at zero by generating a signal which, reproduced through the loudspeaker 2, cancels the pressure at the pressure-sensing microphone 1. Thus a so-called acoustic throat is created. If a positive pressure peak (acoustic wave) arrives at the pressure-sensing microphone 1, the beam of the loudspeaker 2 will move backwards, whereupon the pressure at the microphone 1 decreases. Thus the device "absorbs" the acoustic wave. When the device is placed in a corner of a room, the result is the elimination or attenuation of room resonances. In practice, several such devices are needed in the room, and the effective frequency range is about 20–200

Hz.

Figure 2:
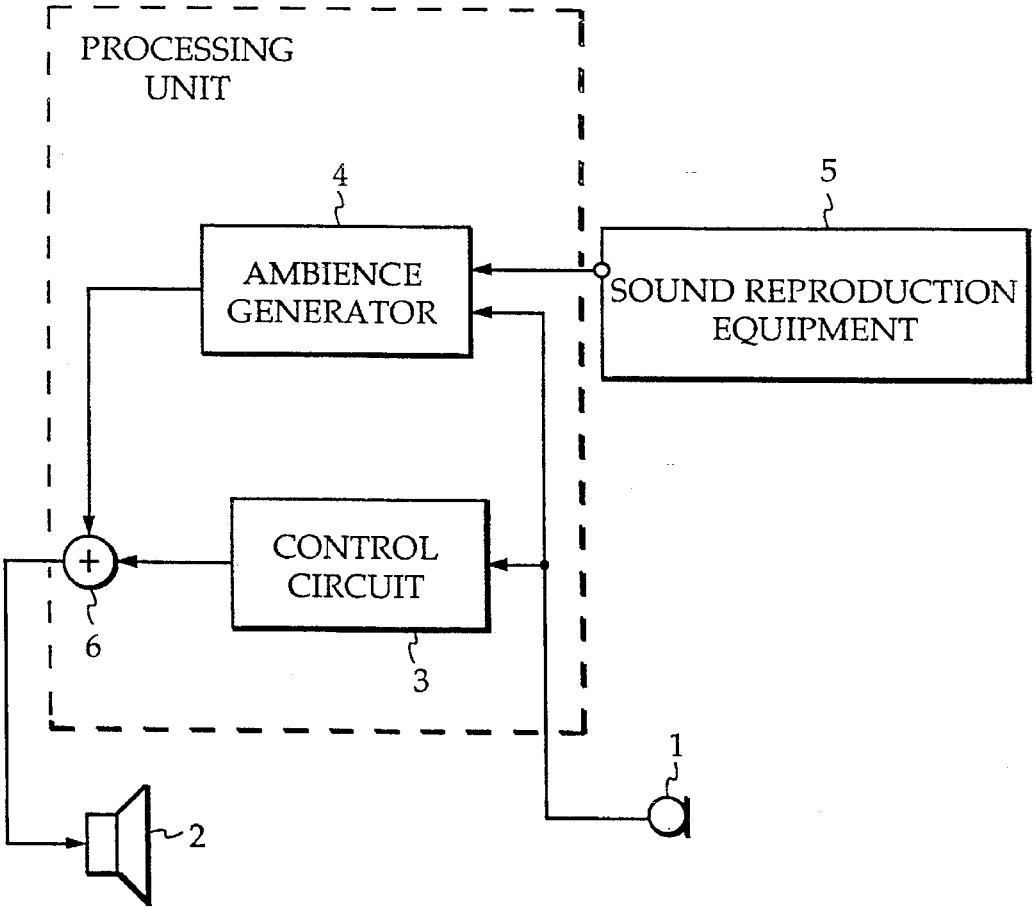
FIG. 2 shows a device according to the invention for changing the acoustic properties of a room.

FIG. 2 shows a device of the present invention for changing the acoustic properties of a room. This device according to FIG. 2 comprises as a basis the device of FIG. 1 in its entirety. In addition to this, the device comprises an ambience generator 4 which also feeds its output to the loudspeaker 2. Therefore, the outputs of the control circuit 3 and ambience generator 4 are summed at point 6. It may be stated that in the known solution of FIG. 1, the loudspeaker 2 can be a loudspeaker capable of reproducing only low frequencies. In the device of the invention, however, the loudspeaker 2 must be able to reproduce the entire frequency band of the audio range, that is, about 20 to 20,000 Hz. In the device of the invention, the ambience generator 4 has been adapted to receive its control signal, which must be a signal proportional to the sound present in the space where the device is located, either directly from the sound reproduction equipment 5 or from the pressure-sensing microphone 1.

Figure 3:
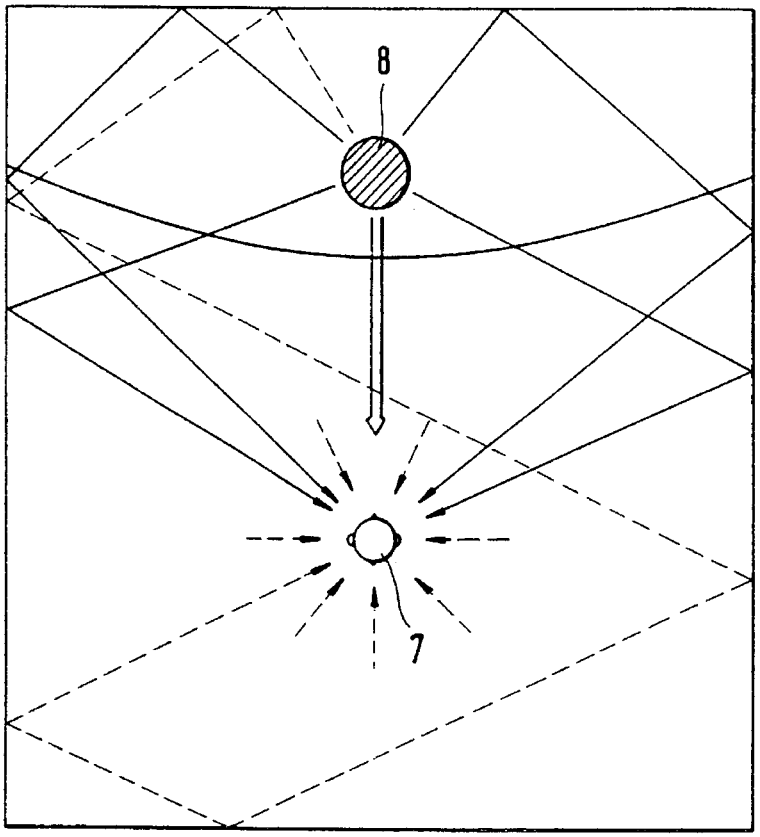
FIG. 3 shows a room with acoustic waves present therein.
Figure 4:
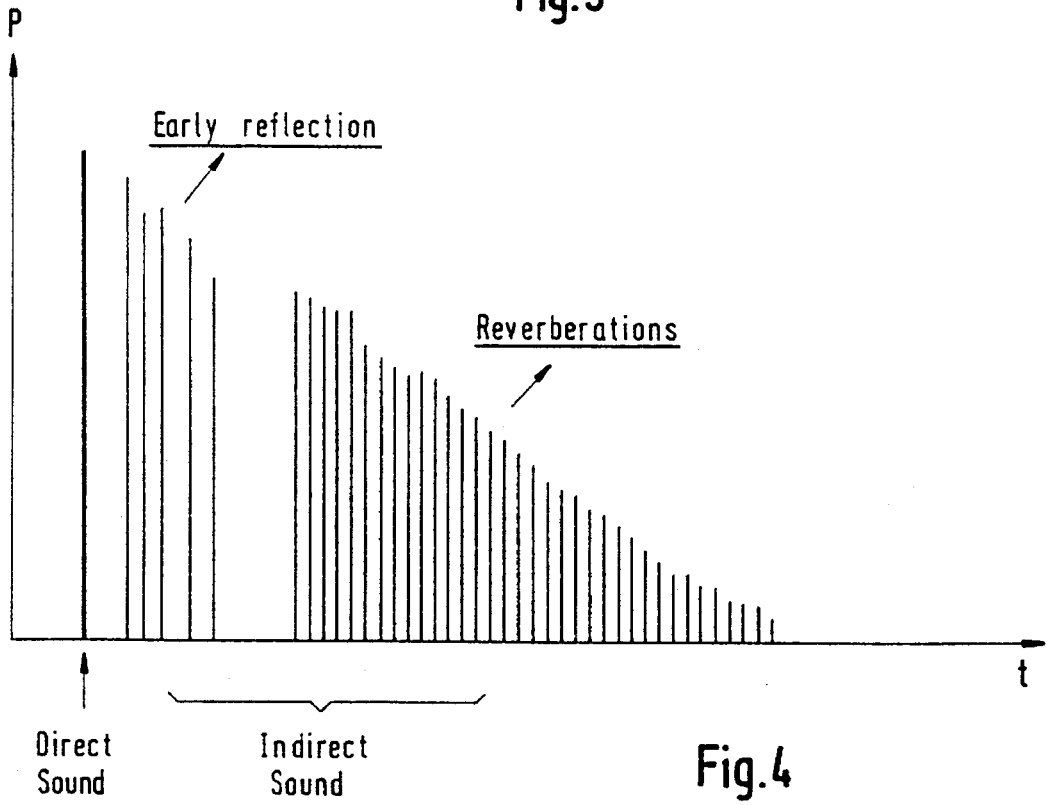
FIG. 4 shows a signal generated by the ambience generator of the device of the invention on a time-power scale.

FIG. 3 shows the acoustic waves present in a room when the listener 7 and the sound source 8 are stationed centrally in the room opposite one another. In that situation, the listener 7 receives from the sound source 8 first a direct acoustic wave indicated with a large arrow and additionally early reflections indicated in solid line and reverberations indicated in broken line. There must be a sufficient quantity of early reflections, and also the reverberation field must be dense enough and have sufficient duration. Then music reproduced in a room furnished with the equipment of the invention can sound the same as for instance in a concert hall. Since there are too few early reflections and the reverberation is too sparse and short in a typical room, the ambience generator 4 is adapted to produce for instance signals of the kind shown in FIG. 4. In this Fig., direct sound received by the ambience generator either directly in an electrical form from the sound reproduction equipment 5 or by "listening" in the room by means of a microphone, for instance a pressure-sensing microphone 1, is illustrated furthest left on the time axis t. In response to the signal received, the ambience generator 4 generates signals which have in FIG. 4 been denoted as early reflections and reverberations. These are signals corresponding to direct sound, but they are appropriately delayed and attenuated.

The reverberation produced by the ambience generator should preferably be adapted to the inherent reverberation of the room in order for the final result to be the optimum. For this reason, the ambience generator is preferably able to generate several signal patterns of different types corresponding to FIG. 4, and in these patterns the number and power level of the early reflections vary to some extent, as do the level and number of the reverberation signals. By adjusting the level and number of the early reflections and also the level and number of the reverberation signals, one can materially influence the way the music sounds in the room in question.

Figure 5:
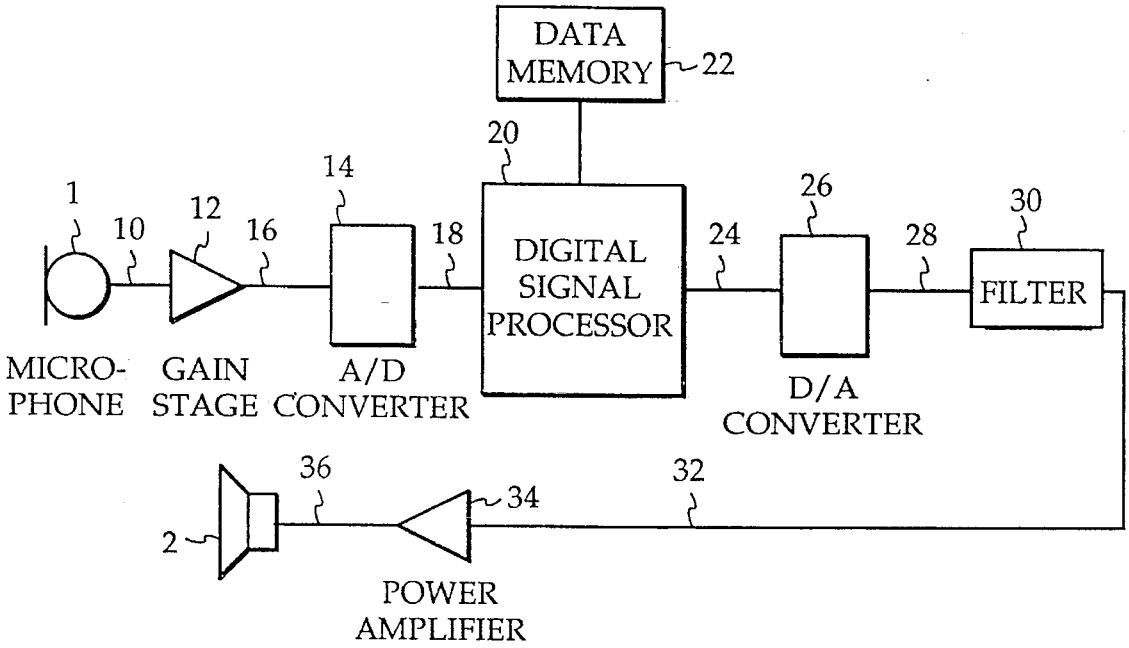
FIG. 5 shows a block diagram of ambience generation and resonance attenuation using only a microphone.

FIG. 5 shows resonance attenuation and ambience generation through a microphone 1 only, i.e., not using sound reproduction equipment 5 of FIG. 2. In that case, when the signals for ambience generation and room resonance attenuation are both received through the microphone, the system construction is in accordance with FIG. 5. First, an analog microphone signal on a line 10 is amplified in a gain stage 12 to match input characteristics of an analog/digital converter 14. An amplified analog signal on a line 16 is converted in the analog/digital converter 14 to a digital signal on a line 18.

In a digital signal processor (DSP) 20 having an associated data memory 22, the digital signal on the line 18 is processed to cancel room resonances and to generate room effects. After processing, the digital signal processor provides an output signal on a line 24 to a digital/analog (D/A) converter 26 for conversion back to an analog signal on a line 28. A reconstruction filter 30 is responsive to the analog signal on the line 28 for correcting output errors in the A/D converter and providing a corrected analog signal on a line 32 to a power amplifier 34 which, in turn, provides a power amplified output signal on a line 36 to the speaker 2 of FIG. 2.

Figure 6:
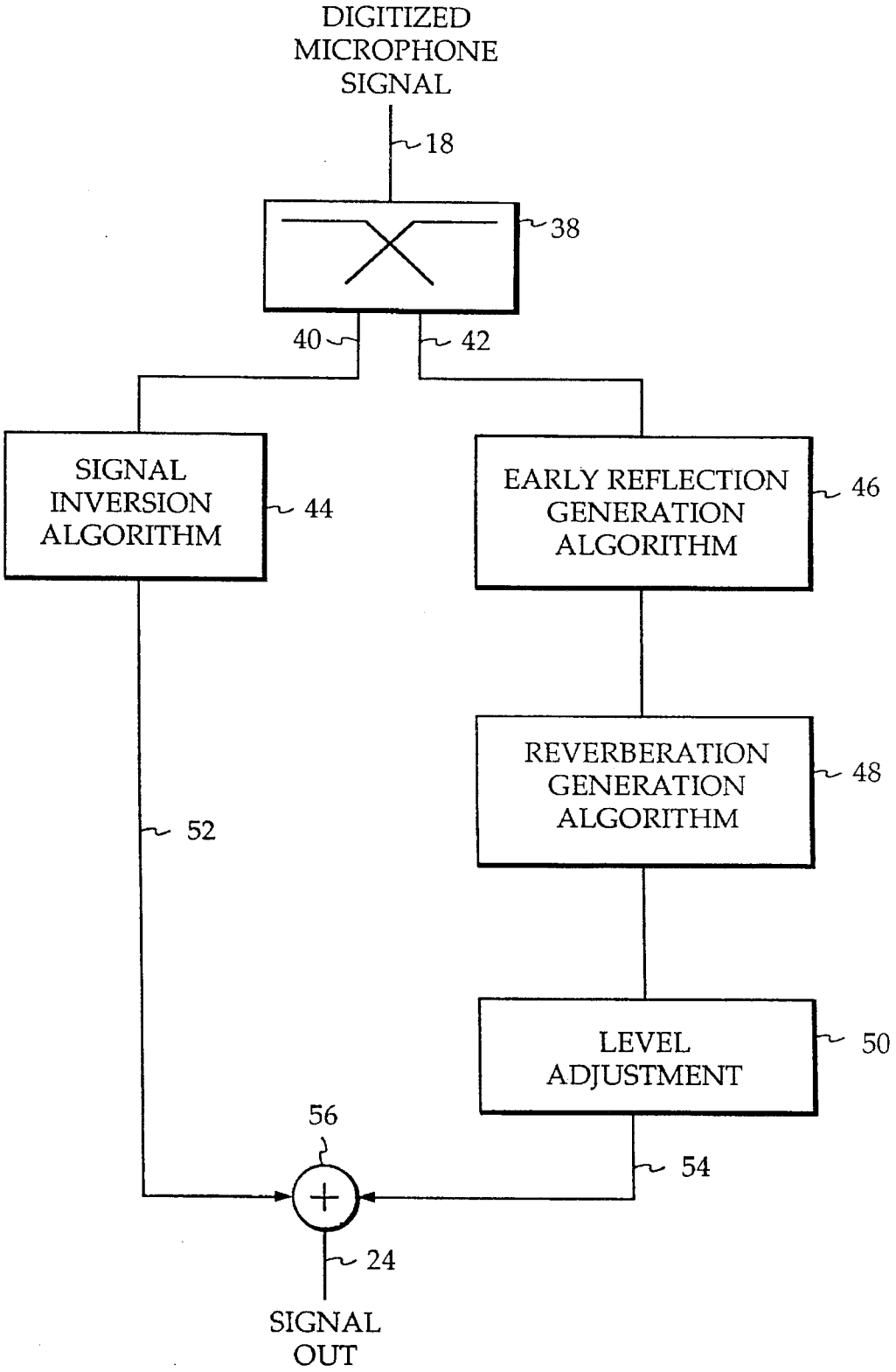
FIG. 6 shows in more detail the signal processing block of FIG. 5.

FIG. 6 shows a block diagram for the digital signal processor of FIG. 5, wherein signals are received only from the microphone, i.e., not from the sound reproduction equipment of FIG. 2. The digitized signal on the line 18 from the microphone is first processed in a crossover filter 38 to divide selected frequencies, as illustrated by different signal paths 40, 42. Frequencies under 300 Hz are represented on the signal line 40 provided to a signal inversion algorithm 44, and upper frequencies are illustrated on the signal path line 42 provided to an early reflection algorithm 46.

The signal inversion algorithm can, for instance, simply be an inversion of the signal. It is also possible, however, to use more advanced adaptive algorithms to get better performance for the room resonance attenuation.

In the early reflection algorithm 46, the high frequencies are processed to get early reflections to produce the desired room effects. The principle is to add delayed signals to the straight sound so that the listener experiences them as reflections from different surfaces.

In a reverberation generation algorithm 48, the sound is processed to give an effect of the room size changing. After that, the room effect levels are adjusted in a step 50 to a selected level.

The signal inversion algorithm 44 provides an output signal on a line 52, and the level adjustment block 50 provides an output signal on a line 54 to a summer 56 which sums the signals on the lines 52, 54 in order to provide a summed output signal on the line 24 to the D/A converter 26 of FIG. 5.

Figure 7:
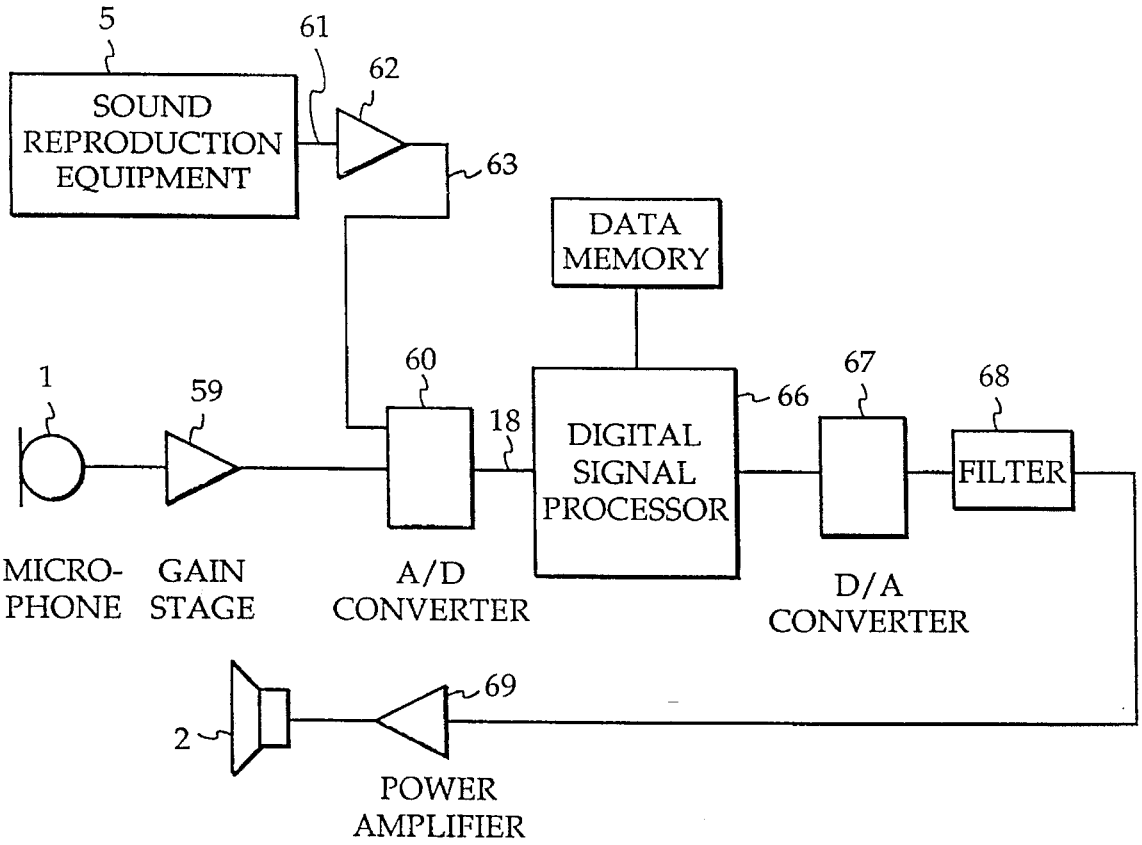
FIG. 7 shows the situation of FIG. 2, where signals for the processing unit are received from both the sound reproduction equipment and a microphone.

FIG. 7 illustrates the case where the sound reproduction equipment 5 of FIG. 2 is used in conjunction with the microphone 1. When the signal for ambience generation is received straight from the signal source 5 and the signal for room resonance attenuation is received through the microphone, the system construction can be according to FIG. 7. First, the analog microphone signal is amplified in a gain stage 59 to match the input characteristics of the A/D converter 60, as in FIG. 5. Then the analog signal is converted in the A/D converter to digital.

The signal received from the sound reproduction equipment on a line 61 is provided to a gain stage 62 and, after amplification, is provided on a line 63 to the A/D converter 60 for converting the analog signal to digital. The rest of the system is similar to that shown in FIG. 5 when both input signals are received through the microphone, i.e., including a DSP 66, D/A converter 67, filter 68, power amplifier 69 and speaker 2.

Figure 8:
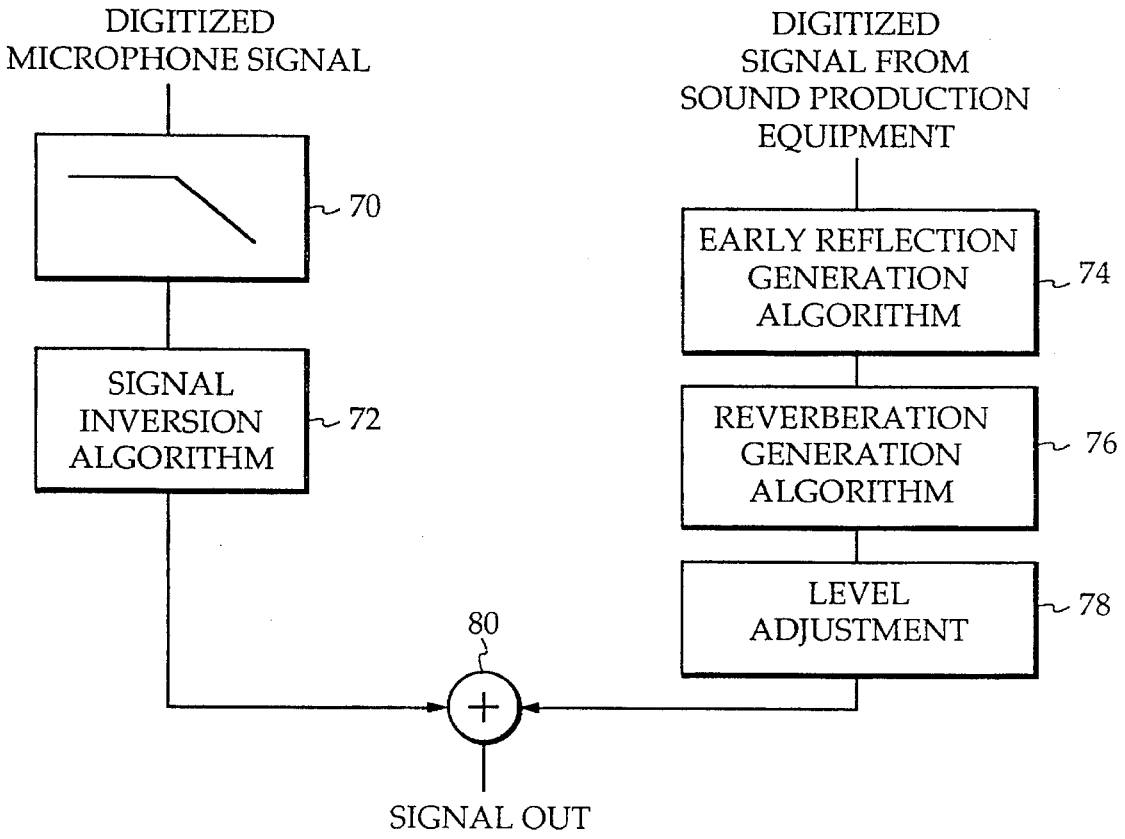
FIG. 8 shows the digital signal processor block of FIG. 7 in more detail, which responds to both microphone and sound reproduction equipment signals, i.e., from two sources.

FIG. 8 shows the digital signal processor block diagram for signals received from two sources such as in FIG. 7. The digitized microphone signal is first processed in a low-pass filter 70 to ensure that only frequencies under 200 Hz are provided to a signal inversion algorithm block 72. The digitized signal from the sound reproduction equipment is provided to an early reflection generation algorithm block 74, and thence to a reverberation generation algorithm block 76 and a level adjustment block 78, as already explained in connection with a similar signal path in connection with FIG. 6. The outputs from the signal inversion algorithm block 72 and the level adjustment block 78 are summed in a summer 80 which provides the output signal of the digital signal processor for the D/A converter 67 of FIG. 7.

Figure 9:
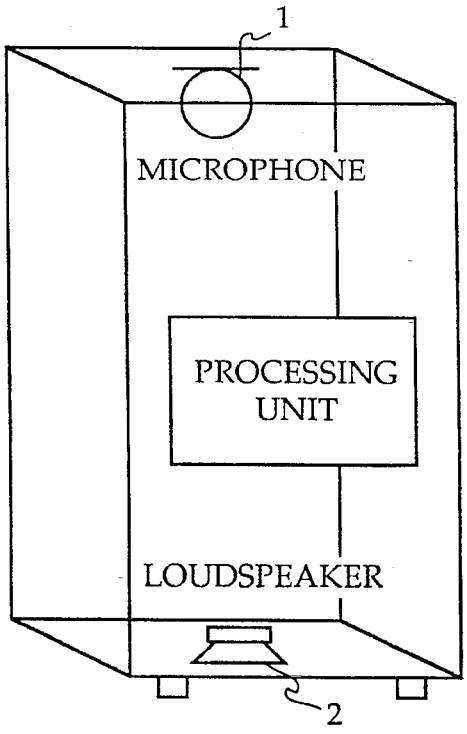
FIG. 9 shows one possible construction of an enclosure that includes the processing unit and the microphone and speaker of FIG. 2.

FIG. 9 shows one possible construction of an enclosure having both the processing unit of FIG. 2 enclosed within and a microphone mounted at one end of the enclosure and a loudspeaker mounted at the other end, as shown. The enclosure may be designed to stand upright, as shown, so that the microphone is at the top and the speaker at the bottom. The processing unit need not be enclosed within the box, but could be outside it. Furthermore, it could be made part of the sound reproduction equipment, which could itself be included within the processing unit per se.

In the foregoing, the device of the invention has been described mainly schematically by means of one exemplary embodiment, and it will be appreciated that the device described can be realized by means of electronic solutions of many different kinds without, however, departing from the essential idea of the invention as defined in the appended claims.

Similarly, although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. A device to be used for changing the acoustic properties of a room, comprising a pressure transducer, a loudspeaker and an electronic control circuit adapted to generate, in response to pressure changes in the room, an electrical signal that serves to cancel the pressure change detected by the pressure transducer when it is reproduced through the loudspeaker, wherein the device further includes an ambience generator adapted to receive an electrical signal proportional to the sound present in the room and to generate, in response to said signal, a second electrical signal which produces an acoustic field containing early reflections and reverberation in the room when reproduced through the loudspeaker.

2. A device as claimed in claim 1, wherein the ambience generator receives the electrical signal proportional to the sound present in the room from sound reproduction equipment.

3. A device as claimed in claim 1, wherein the ambience generator receives the electrical signal proportional to the sound present in the room from said pressure transducer.

4. A device as claimed in claim 1, wherein the pressure transducer is a pressure-sensing microphone, and wherein the electrical signal proportional to the sound present in the room is provided by said pressure-sensing microphone.

5. A device as claimed in claim 1, wherein the loudspeaker is a loudspeaker for the entire audio range.

6. A device as claimed in claim 2, wherein the loudspeaker is a loudspeaker for the entire audio range.

7. A device as claimed in claim 3, wherein the loudspeaker is a loudspeaker for the entire audio range.

8. A device as claimed in claim 4, wherein the loudspeaker is a loudspeaker for the entire audio range.

9. A device as claimed in claim 2, wherein the pressure transducer is a pressure-sensing microphone.

10. A device as claimed in claim 3, wherein the pressure transducer is a pressure-sensing microphone.

* * * * *